United States Patent [19]

Suzuki

[11] 4,171,157

[45] Oct. 16, 1979

[54] IMPROVED ELECTROPHOTOGRAPHIC APPARATUS FOR MULTIPLE COPIES

[75] Inventor: Yoshiro Suzuki, Hachioji, Japan

[73] Assignee: Olympus Optical Co., Ltd., Tokyo, Japan

[21] Appl. No.: 891,391

[22] Filed: Mar. 28, 1978

[30] Foreign Application Priority Data

Mar. 30, 1977 [JP] Japan ..... 52-34361
Mar. 31, 1977 [JP] Japan ..... 52-36483

[51] Int. Cl.[2] ..... G03G 15/00
[52] U.S. Cl. ..... 355/3 TR
[58] Field of Search ..... 355/3 TR, 3 TE, 3 R; 96/1.4, 1 TE; 427/24

[56] References Cited

U.S. PATENT DOCUMENTS 3,692,402 9/1972 Solarek ..... 355/15 X
3,879,121 4/1975 Simpson ..... 355/3 TR

*Primary Examiner*—R. L. Moses
*Attorney, Agent, or Firm*—Haseltine, Lake & Waters

[57] ABSTRACT

An electrophotographic apparatus comprises an electrostatic charge retentive drum composed of a metal cylindrical body and a photosensitive or insulating charge retentive layer applied on the cylindrical body. A corona charger serves to homogeneously change the charge retentive layer, and an optical system projects an optical image of a document to be copied onto the charge retentive layer so as to form a latent image. The latent image is developed with toners into a toner image and transferred onto a paper. The toner image is fixed on the paper and the whole surface of the charge retentive layer is cleaned.

The electrophotographic apparatus allows selective application of a transfer bias voltage to so as to prevent at least partially undesired charge from being deposited on the charge retentive layer. The transfer bias voltage is applied only when the paper exists in the transfer region. Undesired charge on a peripheral portion of the charge retentive layer can be erased either in photoelectric or electric manner. In the former case, a peripheral portion of the charge retentive layer having a given width is illuminated so as to discharge undesired charge through the cylindrical body. In the latter case, an electrically conductive erasing member is brought into contact with the peripheral portion of the charge retentive layer so as to discharge undesired charge through the erasing member. The invention is particularly preferable to be applied to such an electrophotographic apparatus in which the development and transfer steps are repeatedly effected for a single latent image once formed on the charge retentive layer so as to form a number of copies at a high speed.

14 Claims, 11 Drawing Figures

IMPROVED ELECTROPHOTOGRAPHIC APPARATUS FOR MULTIPLE COPIES

BACKGROUND OF THE INVENTION

This invention relates to an electrophotography and, more particularly to an electrophotographic apparatus in which a number of copies can be formed from a single electrostatic charge latent image.

In electrophotograpy it has been known to form a copy image by effecting the following successive steps; i.e. a step of forming an invisible electrostatic charge latent image on a member such as a photosensitive drum, an electrostatic charge transfer drum, etc., which can retain the electrostatic charge latent image for a relatively long time period, a step of developing the latent image with electrostatically charged toner particles and a step of transferring a developed toner image onto a toner image receiving member such as a plain paper. For the transferring step there have been proposed several processes. In a corona discharge transfer process, for example, onto a rear surface of the toner image receiving member, i.e. paper is applied a corona charge having a polarity opposite to that of the toner particles. In a bias roller transfer process there is provided a transfer roller composed of an electrically conductive roller with or without a thin insulating layer coated thereon and the paper is fed between the latent image retentive member and the transfer roller with applying a suitable bias voltage thereacross. In the corona discharge transfer process a homogeneous corona charge which is essential for effecting complete transfer could not be applied on the rear surface of the paper unless a corona charge potential is made sufficiently high. On the other hand when a plain paper having a resistance of about $10^{10} \sim 10^{14}\Omega$-cm is used, a corona ion stream might be injected onto the latent image retentive member through the paper under the high corona charge potential and as a result the latent image might be deteriorated or destroyed and overdevelopment or fog might occur in a final copy. In the bias roller transfer process a transferring efficiency is very low due to undesired phenomenon that a center part of the toner image on the charge retentive member is remained untransferred in dependence on a contact pressure of the transfer roller, an amount of developed toner particles and a fluidity of particulate toners. If the bias voltage is made as high as to obtain a satisfactory development efficiency, the latent image might be deteriorated as in the case of the corona discharge transfer process. Thus, in general the bias roller transfer process is not suitable for a high speed transfer process.

In electrophotography it has been also known to form a number of duplicated copies from a single electrostatic latent image. In this case the latent image once formed on the charge retentive layer of the transfer drum or photosensitive drum is alternately and repeatedly subjected to the toner development and transfer processes.

If the above explained known corona discharge and bias roller transfer processes are utilized in the electrophotographic apparatus which forms a number of copies from the single electrostatic latent image, it is quite difficult to obtain a number of copies of high image quality. This is due to the fact that the electrostatic image is deteriorated by the corona charge and bias potential and the toner image on the retentive member is also damaged to a great extent by discharge which might be produced when the paper leaves the charge retentive member. Thus the quality of the copy images is extremely low and overdevelopment might appear as a dot form.

The inventor has proposed an improved electrophotographic process which can obviate the above mentioned drawbacks and a number of copies can be formed at a high speed from a single latent image without deteriorating it. In this process bias voltages are applied across the latent image storing member and the paper and across the charge storing member and an electrically conductive screen or grid arranged between the storing member and the corona charger, respectively and the paper is charged with corona ions passing through the grid.

FIG. 1 is a schematic view of an electrophotographic apparatus which operates under the above improved printing process. In this embodiment as an electrostatic charge retentive member use is made of a transfer drum 1 composed of an electrically conductive roller 2 arranged rotatably in the direction shown by an arrow and an electrostatic charge retaining layer 3 coated on the surface of roller 2. As the charge retentive layer 3 use may be made of insulating material having a high dielectric constant such as a glass film having a high lead content, an organic resin such as acryl resin, polyurethane resin, epoxy resin, etc. On the transfer member 1 an electrostatic latent image 5 corresponding to an image of a document (not shown) is formed by a latent image forming device 4 in accordance with a known method such as a Transfer of Electro-Static Image (TEST) method, corona ion stream modulation method with using a photosensitive screen, a multistylus method commonly used in the field of facsimile. The latent image 5 may be positive or negative in polarity. In the present case the latent image has a negative polarity.

Then the electrostatic latent image 5 is developed with toner particles by a developing device 6 in accordance with a known development process such as a cascade development process and a magnetic brush development process. In this manner a visual toner image 7 is formed on the transfer drum 1. Next this toner image is transferred onto a toner image receiving member such as a plain paper.

At the transfer position there are provided a pair of transfer rollers 8A and 8B in the close vicinity of or in contact with the transfer member 1, an electrically conductive grid 9 of about 100 to 200 mesh arranged in opposite to the transfer drum 1 between said transfer rollers 8A, 8B and a corona charging device 10 arranged in opposite to the transfer member 1 with respect to the screen 9 and connected to a corona voltage supply source 12. During the transfer process a paper 11 is fed with being in contact with the transfer drum 1 with a slight pressure by means of the transfer rollers 8A, 8B and the corona charger 10 projects through the screen 9 corona ions having a polarity which is same as that of the charge forming the latent image, but is opposite to that of the toner particles forming the visual toner image. There are further arranged voltage sources 13 and 14 between the conductive drum 2 and grid 9 and between the conductive drum 2 and transfer rollers 8A, 8B, respectively so as to apply suitable transfer bias voltages thereacross, respectively.

By means of such a transfer process the toner image 7 can be effectively transferred onto the paper 11 at high speed without deteriorating the latent image on the transfer drum 1. Then the paper 11 having the toner image transferred thereto is separated from the drum 1 with the aid of a scraping claw 15. The toner image thus transferred is fixed in a known fixing process and a final duplicated copy is formed. The latent image 5 on the drum 1 is effectively remained and thus by carrying out alternately and repeatedly the development and transfer processes a number of copies such as 200 to 250 copies can be obtained from the single latent image 5 once formed on the transfer drum 1.

After a given number of copies have been formed the remaining latent image and residual toner particles are removed by means of a known cleaning device 16 so as to prepare for a next printing operation.

In the electrophotographic apparatus shown in FIG. 1 if the toner image receiving member, i.e. paper 11 is alway existent at the transfer position and the transfer corona charge voltage and bias voltage are in good condition, a number of copies can be obtained from a single latent image. But, in practice the toner image receiving member is not always existent at the transfer position. For instance in case of using sheet papers successive papers are fed into the transfer position in an intermittent manner and during intervals between successive papers the transfer rollers 8A, 8B and the corona charger 10 face directly the transfer drum 1. This is also the case in which a roll paper and a cutter are used. During such intervals the transfer corona charge and bias voltage are directly applied to the charge retentive layer 3 of the transfer drum 1 and as a result the retentive layer 3 is charged with the same polarity as that of the latent image 5. Thus in a next development process toner particles might adhere to undesired portions of the transfer drum 1, which have been newly charged in the previous transfer process, as well as to the electrostatic latent iamge. In a next transfer process the toners on the undesired portions might be transferred to a front or rear edge of a next coming paper 11 and thus the paper might be soiled or stained. Further the toners on the undesired portions of the transfer drum 1 might adhere to the transfer rollers 8A and 8B and as a result the rear surface of the paper 11 becomes soiled. Moreover since the bias voltage is applied to the charge retentive layer 3 directly by the transfer rollers 8A, 8B there might be produced breakdown in the retentive layer 3 and if the retentive layer 3 is made of photosensitive material, its life time might be extremely shortened.

FIG. 2 shows a situation in which the front edge of the paper 11 is just inserted into the transfer position. Since the transfer bias voltage is applied before the paper 11 enters in a transfer region T, the charge retentive layer 3 is charged by means of the transfer corona charger 10 and transfer rollers 8A, 8B with the same polarity as that of the latent image 5. In case of forming a single copy the residual charge and toners on the retentive layer 3 are removed by the cleaning device 16 (FIG. 1) and thus there is not problem. But in case of printing a number of copies from the single latent image with repreating alternately the development and transfer processes it is not suitable to operate the cleaning device 16 during the printing operation, because it affects the latent image 5 very much. Therefore in case of the multiple printing the charge deposited on the undesired portions of the charge retentive layer 3 is developed with toners and the toners are liable to be transferred onto the front and rear edges of the paper 11, because usually it is quite difficult to registrate accurately the paper with respect to the transfer drum 1.

Further when the toners adhered to that portions of the transfer drum 1 which are free from the latent image 5 come under the transfer range T, these toners 17 are subjected to corona ions as shown in FIG. 3 and are charged with neutral or negative polarity. Since the adhesive force of these toners is weak, they are liable to be transferred to the downstream roller 8B or to spread in a space and thus the front and rear surfaces of the paper 11 might be soiled to a great extent.

SUMMARY OF THE INVENTION

The present invention has for its object to provide a novel electrophotographic apparatus which can mitigate the above mentioned drawbacks of the known electrophotographic apparatuses, can protect effectively the electrostatic latent image formed on the charge retentive member and can form a number of copies of high quality from a single latent image without overdevelopment and contamination.

To this end an electrophotographic apparatus according to the invention comprises an electrostatic charge retentive member including an electrically conductive substrate and a charge retentive layer applied on the substrate, means for forming on the charge retentive layer an electrostatic latent image corresponding to an image to be printed, means for developing the latent image with toner particles into a visual toner image, means for transferring the toner image onto an image receiving member which is fed with being in contact with the charge retentive layer at least at a transfer region, means for applying a transfer bias voltage across the conductive substrate of the charge retentive member and the toner image receiving member, and means for preventing undesired charge from being retained on at least a part of that portion of the charge retentive layer which is not covered with the toner image receiving member.

DESCRIPTION OF THE PREFERRED EMBODIMENTS

Figure 1:
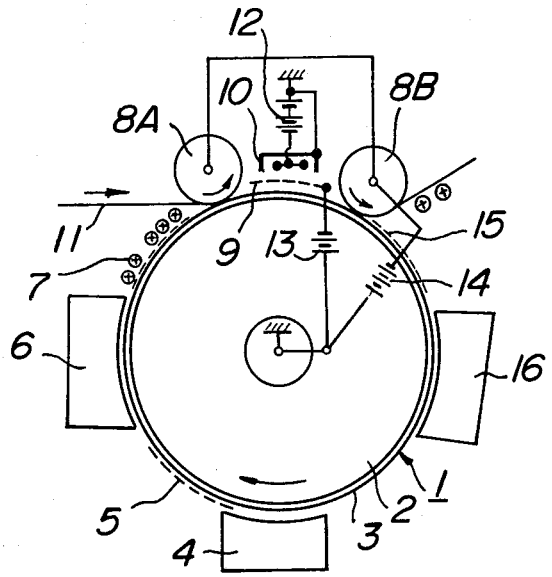
FIG. 1 is a schematic view showing diagramatically a known electrophotographic apparatus.
Figure 2:
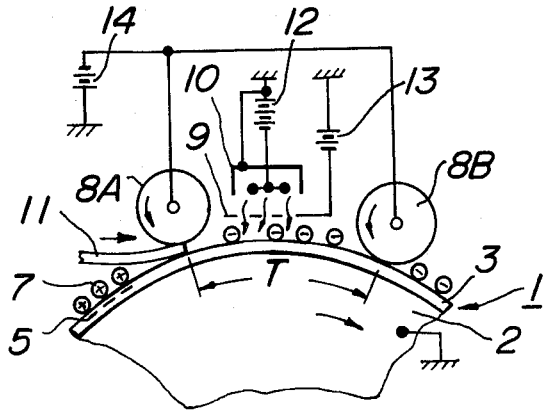
FIG. 2 is a schematic view illustrating a transfer section of the apparatus shown in FIG. 1.
Figure 3:
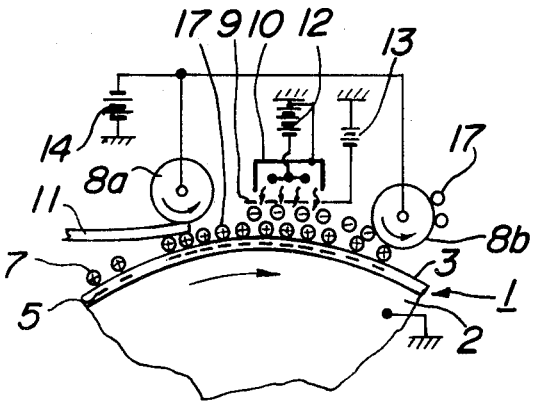
FIG. 3 is a schematic view showing the transfer section of FIG. 2.
Figure 4:
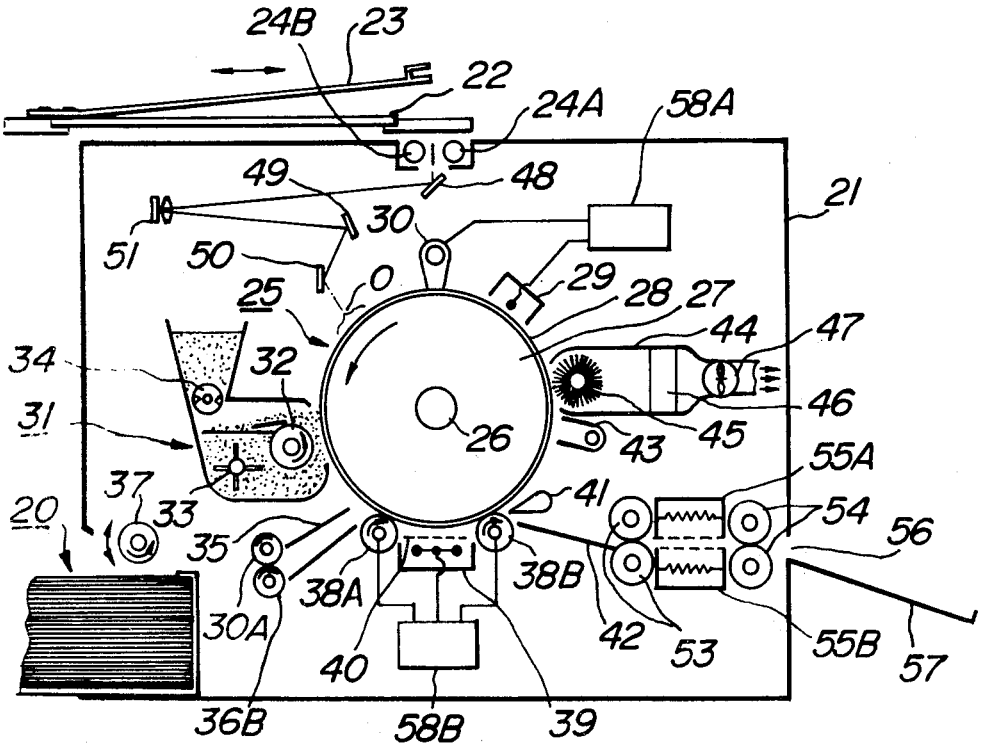
FIG. 4 is a diagramatic view showing schematically an embodiment of an electrophotographic apparatus according to the invention.

FIG. 4 is a schematic view showing an embodiment of an electrophotographic apparatus according to the invention. The electrophotographic apparatus comprises a casing 21, on an upper surface of which is slidably arranged a document table 22 with a flexible cover 23. Underneath the table 22 there are provided a pair of illumination lamps 24A, 24B. In the casing 21 there is arranged a photosensitive drum 25 which rotates about a shaft 26 in a direction shown by an arrow. The drum 25 is composed of an electrically conductive metal cylinder 27 and a photosensitive layer 28 applied on the cylinder. Along a circumference of the drum 25 there are arranged a corona charger 29 for charging the photosensitive layer 28, a discharging lamp 30 whose function will be explained later, a magnetic brush development device 31 including a magnet roller 32, a stirring roller 33 for mixing toner particles with magnetic carriers, a roller 34 for supplementing a given amount of toners, a paper guide 35 for guiding a paper fed by a pair of paper guide rollers 36A, 36B and a pick-up roller 37 from a paper cassette 20, a pair of transfer rollers 38A and 38B, a transfer corona charger 39 with an electrically conductive grid or screen, a claw 41 for separating the paper having a toner image transferred thereto from the drum 25, a paper guide 42, a lamp 43 for photoelectrically discharging the whole surface of the drum 25, and a cleaning device 44 for removing residual toner particles from the drum 25 and including a brush roller 45, a filter 46 and a fun 47. Between the lamp 30 and the development device 31 there is provided an optical image projection area O at which a light reflected from a document (not shown) on the table 22 is projected onto the drum 25 by means of mirrors 48, 49 and 50 and an in-mirror lens 51. After the toner image has been transferred to the paper the paper is fed by the guide 42 to a fixing device 52 which comprises rollers 53 and 54 and heaters 55A and 55B. The final copy having the toner image fixed thereto is fed through an opening 56 formed in the casing 21 and is collected on a tray 57.

According to the invention the lamp 30, the transfer rollers 38A, 38B and the transfer corona charger 39 are so controlled that electrostatic charge is not remained on at least a part of an undesired portion of the transfer drum 25, which portion is not covered with the paper. To this end the corona charger 29, the clamp 30, the transfer rollers 38A, 38B and the transfer charger 39 are connected to control circuits 58A and 58B.

For example, when the drum 25 has a width measured in its axial direction equal to a width of a paper of B4 size, i.e. 260 mm and a paper of A4 size having a width of 210 mm is used, a peripheral portion of the drum 25 having a width of 50 mm will not be covered with the paper and thus is electrostatically charged during the transfer step by means of the transfer rollers 38A, 38B and transfer corona charger 39. In a next development step toners might be adhered to such a charged peripheral portion of the drum 25 so as to cause the various drawbacks mentioned above.

According to the invention in order to remove or erase such an undesired charge on the peripheral portion of the drum 25 there is provided the lamp 30 which projects light ray onto the peripheral portion of the drum 25. An area of the drum which is illuminated by light ray from the lamp 30 has to be changed in accordance with the sizes of papers to be used. This can be effected either mechanically or electrically. In a mechanical illumination control the lamp 30 is so constructed that the maximum peripheral portion of the drum 25 is illuminated and in front of a lamp house there is further arranged a shutter movably in the axial direction of the drum 25. In accordance with the paper size the shutter is driven by an electric motor or solenoid so as to illuminate a given peripheral portion of the drum 25. In an electric illumination control there are arranged a plurality of lamps in the axial direction of the drum 25 and a selected number of lamps are simultaneously energized in accordance with the paper size. In either illumination control undesired charge on the peripheral portion of the drum can be photoelectrically removed.

Figure 5:
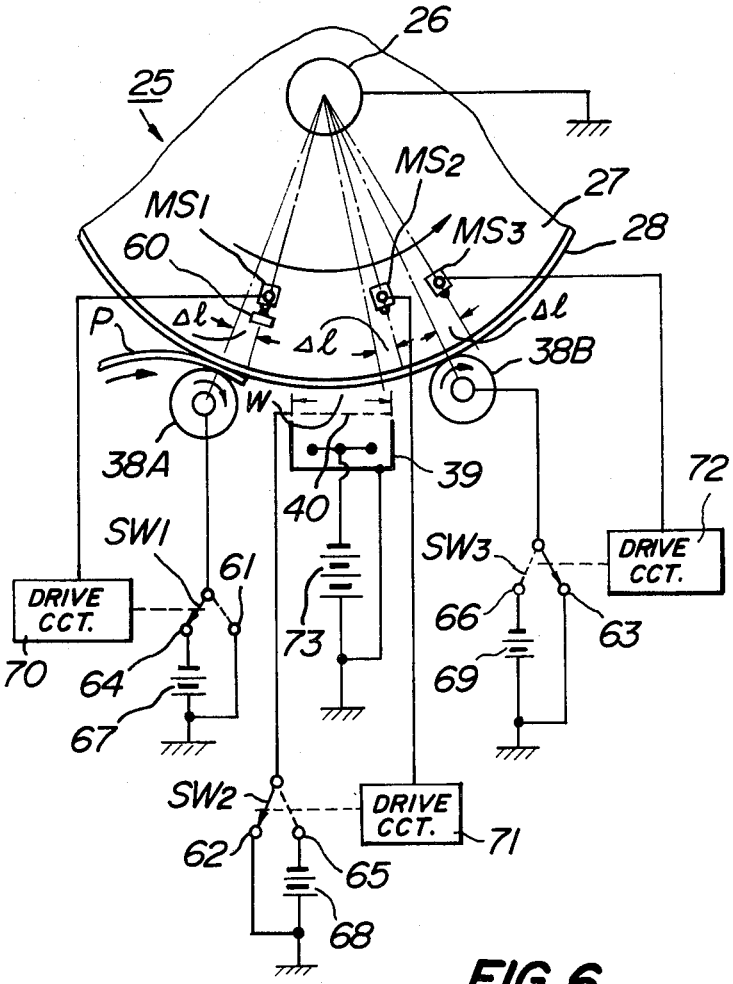
FIG. 5 is a schematic view illustrating in detail a transfer section of the apparatus shown in FIG. 4.

FIG. 5 is a schematic view illustrating the transfer portion of the electrophotographic apparatus shown in FIG. 4. There are provided three micro switches MS1, MS2 and MS along a circle about the shaft 26 successively in the rotational direction of the drum 25 shown by an arrow. These micro switches are made opposed to one of side walls of the metal cylindrical body 27, to which side wall is secured a projection 60 for actuating the micro switches successively by rotating the drum 25. The projection 60 has to be provided at such a position that it can ensure a synchronism with a front edge of the paper P which is fed at the same speed as the rotation speed of the drum 25. The micro switches MS1, MS2 and MS3 are arranged at such a position that the projection 60 comes into contact with these micro switches successively after the drum 25 has been rotated by a distance $\Delta l$ from the transfer roller 38A, the edge of the transfer corona charger 39 and the transfer roller 38B, respectively.

The transfer rollers 38A and 38B made of electrically conductive or semiconductive material are connected to switching arms of switches SW1 and SW3, respectively and the grid 40 of the transfer corona charger 39 is connected to a switching arm of a switch SW2. Normally close contacts 61, 62 and 63 of these switches SW1, SW2 and SW3 are connected to the earth and the other contacts 64, 65 and 66 are connected to bias voltage supply sources 67, 68 and 69, respectively. The switching arms of the switches SW1, SW2 and SW3 are actuated by driving circuits 70, 71 and 72, respectively which are connected to the micro switches MS1, MS2 and MS3, respectively. Each of the driving circuits produces an actuating signal having a given time period.

Corona wires and shield body of the corona charger 39 are connected to a corona voltage supply source 73 and the earth, respectively. The conductive cylindrical body 27 is connected to the earth by means of, for example the shaft 26.

As shown in FIG. 5 when the paper P is inserted in the transfer region by a small distance $\Delta l$, the micro switch MS1 is actuated by the projection 60. Then the driving circuit 70 actuates the switch SW1 and its switching arm is changed over into the contact 64 as shown by a solid line. In this manner a bias voltage VR1 is applied to the transfer roller 38A from the bias voltage source 67 so as to effect the transfer operation by means of the transfer roller 38A. As the paper P is further fed the micro switches MS2 and MS3 are successively actuated by the projection 60 and the switches SW2 and SW3 are successively actuated by means of the driving circuits 71 and 72, respectively into positions shown by dotted lines. Then the conductive screen 40 is applied with a bias voltage VC1 for controlling a corna ion stream and the transfer roller 38B is applied with the transfer bias voltage VR2. Since the corona wires are always connected to the corona voltage source 73 it produces the corona ions even before the micro switch MS2 is actuated. But the corona ions cannot pass through the screen 40 as long as the screen is at the earth potential. When the micro switch MS2 is actuated by the projection 60, the paper P has entered into the corona charge region and thus the corona ions begin to reach the rear surface of the paper P in synchronism with the actuation of the micro switch MS2.

As explained above the driving circuits 70, 71 and 72 determine the actuation times of the switches SW1, SW2 and SW3. The switches SW1 and SW3 are maintained to be actuated for a time period $T_1$ equal to $(L-2\Delta l)/V$ wherein L and V are a length and a traveling velocity of the paper P, respectively. It should be noted that the velocity V is equal to a circumferential velocity of the drum 25. After the time period $T_1$ has been elapsed from the actuation instances of the switches SW1 and SW3 they return to the initial positions. The screen 40 of the transfer corona charger 39 is connected to its bias voltage source 68 for a time period $T_2$ equal to $$\{L-(W+2\Delta l)\}/V$$

wherein W is the effective charge region of the charger 39. After the time period $T_2$ has been elapsed the screen 40 is connected to the earth potential and corona ions do not pass through the screen.

As explained above according to the invention the transfer bias voltages VR1, VR2 and VC1 are applied to the transfer rollers 38A, 38B and corona charger 39 only when the paper P is existent in the transfer region and thus undesired charge is hardly applied to that portion of the drum 25 which is not covered with the paper P. Moreover since the charge retentive surface of the drum 25 is not directly biased by the transfer rollers 38A, 38B and corona charger 39 the charge retaining layer is effectively protected against breakdown.

Since it is necessary to apply the transfer bias voltages during the paper P travels in the transfer region if the width of paper is shorther than the width of the drum 25, one or both of the peripheral portions of the drum 25 is brought into contact with the transfer rollers 38A, 38B and is also subjected to the transfer corona ions so as to be charged electrostatically. But this undesired charge can be removed by the lamp 30 as described above. In this manner undesired charge on the drum 25 can be substantially completely removed. But according to the invention it is not always necessary to remove undesired charge completely. For example in the above explained embodiment the lamp 30 may be dispensed with or the transfer bias voltages may be always applied to the transfer rollers 38A, 38B and/or transfer corona charger 39.

The transfer bias control circuit shown in FIG. 5 may be modified in various ways. For example, the driving circuits 70, 71 and 72 may not have the timing function and two projections are provided on the side wall of the drum 25 at positions corresponding to front and rear edges of the paper P, respectively. When the micro switches MS1, MS2 and MS3 are actuated by the first projection, the switches SW1, SW2 and SW3 are driven so as to apply transfer bias voltages and when the second projection actuates the micro switches, the switches SW1, SW2 and SW3 are returned into initial positions so as to cease the application of the bias voltages. Moreover the micro switches may be omitted and use may be made of a timer circuit which is driven in synchronism with the rotation of the drum 25. The timer circuit may be also controlled by a rotational angle of the drum 25.

In the embodiment illustrated in FIG. 4 there is provided the lamp 30 for erasing or cleaning undesired electrostatic charge on the peripheral portion of the drum 25. This erasing operation can be also effected by means of a mechanical cleaning device. Now a few embodiments of such a mechanical cleaning device will be explained with reference to the drawings.

Figure 6:
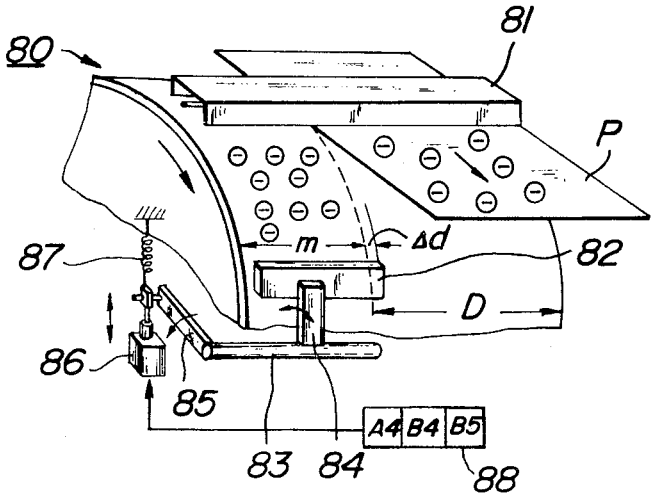
FIG. 6 is a perspective view showing an embodiment of an electrostatic charge erasing device according to the invention.

FIG. 6 is a partial perspective view illustrating a first embodiment of the mechanical charge cleaning device according to the invention. Near an electrostatic charge retentive drum 80 rotating in a direction shown by an arrow is arranged a transfer corona charger 81. Between the drum and corona charger a paper P travels in a direction illustrated by an arrow. The paper has a width D which is shorther than a width of the drum 80 by a distance m. There is arrange a charge erasing member 82 in a form of a plate having a length $(m+\Delta d)$, $\Delta d$ being a few millimeters. That is to say the erasing member 82 slightly projects into an edge portion of a printing area of the drum 80, which printing area is covered with the paper P. But in a usual case this does not cause any trouble, because important information is scarcely contained at the edge portion. A surface of the erasing member 82 which is made in contact with the drum surface is formed by a felt immersed with electrically conductive and volatile solusion or electrically conductive rubber. In order to erase undesired charge on the drum 80 the erasing member 82 or at least its conductive surface has to be connected to the earth.

The charge erasing member 82 is coupled with a rod 83 by means of an arm 84, the rod 83 being journaled rotatably about its longitudinal axis. One end of the rod 83 is coupled with one end of a lever 85 and the other end of the lever 85 is connected to a plunger of a solenoid 86. The plunger is pulled upward by means a spring 87. The actuation of the solenoid 86 is controlled by a control switch 88.

Now it is assumed the paper P of B4 size is used. Then the solenoid 86 is made deenergized and the erasing member 84 is separated from the drum 80 due to a force of the spring 87. Next when a paper size of A4, is selected, the solenoid 86 is energized by the control switch 88. Then the plunger 87 is moved downward against the force of the spring 87 and thus the erasing member 82 is brought into contact with the drum 80. In this manner undesired charge on the drum 80 can be erased. After a given number of copies are formed, the whole surface of the drum 80 is cleaned by means of a conventional cleaning device.

Figure 7:
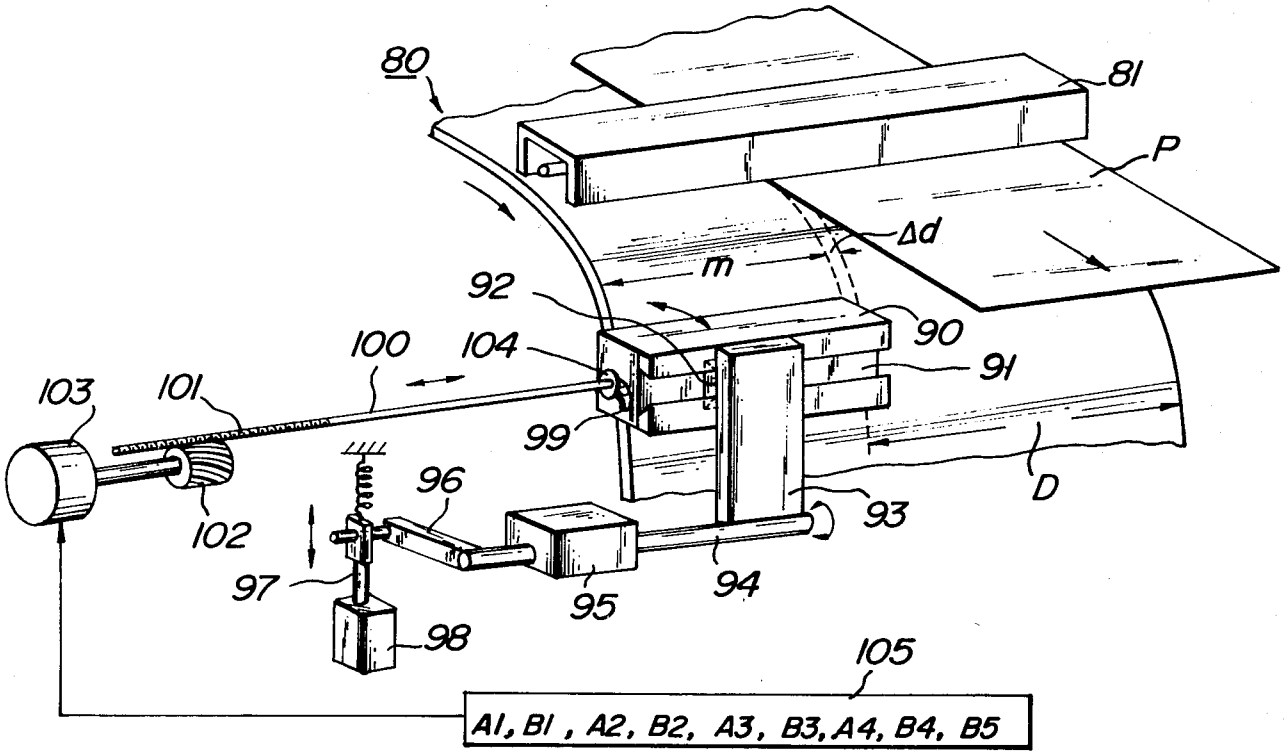
FIG. 7 is a perspective view depicting another embodiment of the charge erasing device according to the invention.

FIG. 7 is a perspective view illustrating another embodiment of the mechanical charge erasing device. The construction of a cylindrical drum 80 and a transfer corona charger 81 is same as that of FIG. 6. A paper P is fed between the drum 80 and the transfer corona charger 81 in the direction shown by an arrow. In this embodiment a casing of a charge erasing member 90 has a groove 91 in which a projection 92 is slidably fit. The projection is secured to an arm 93 which is connected to a shaft 94 rotatably journaled by a bearing 95. To an end of the shaft 94 is secured an arm 95 which is coupled with a plunger 97 of a solenoid 98. In this manner by controlling the operation of the solenoid 98 the erasing member 90 may be swung as shown by a double arrow and a surface of the erasing member 90 is either brought into contract with or separated from the drum 80.

The erasing member 90 can be slid in the axial direction of the drum 80. There is formed an arcuate recess 99 in a side wall of the housing of the erasing member 90. One end portion of a rod member 100 is projected into the housing through the recess 99 and the other end portion of the rod member is provided with a screw thread 101 which engages with a gear 102 coupled to a driving shaft of an electric motor 103. In order to prevent the rod member 100 from being pulling out of the housing of the erasing member 90 there are secured to the rod member a pair of stoppers 104 respective one of which situates on each side of the housing. In this embodiment the contact surface of the erasing member 90 is preferably made of electrically conductive, flexible and elastic material such as felt immersed with conductive and volatile liquid, conductive rubbers, etc. In order to discharge the surface of the drum 80 the erasing member 90 is connected to the earth.

The operation of the motor 103 is controlled by a paper size selecting circuit 105 in such a manner that the motor 103 is energized in accordance with the paper size selected from A1, B1, A2, B2, A3, B3, A4, B4, B5, etc. so as to move the erasing member 90 in the axial direction of the drum 80 into a given position corresponding to the selected paper size. Also in this embodiment the erasing member 90 can cover a peripheral portion of the drum 80 having a given width $m+\Delta d$. The erasing device of this embodiment is applicable to more various paper sizes than the embodiment of FIG. 6.

Figure 8:
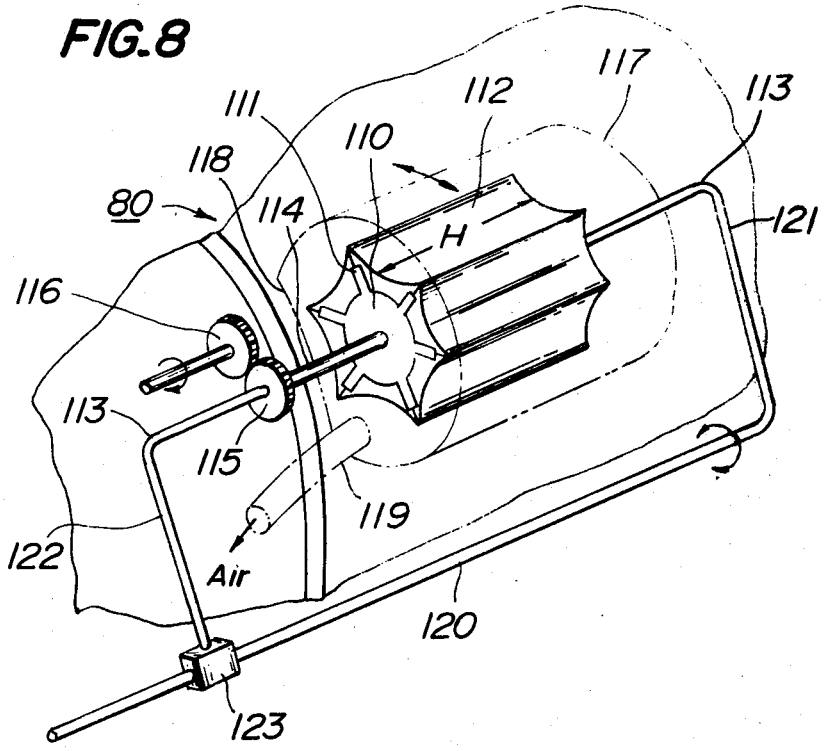
FIG. 8 is a perspective view showing a further embodiment of the charge erasing device according to the invention.

FIG. 8 is a perspective view illustrating further embodiment of the mechanical erasing device according to the invention. There is provided a holder 110 in a form of a water-mill having an axial length H which is slightly longer than a width of a peripheral portion of the drum 80 which is not covered with a paper of minimum size. The holder 110 has six radially extending blades 111 and six erasing members 112 are clamped between successive blades. The assembly of the holder, blades and erasing members has a substantially hexagonal prism. Each of the erasing members 112 has a concave surface having a curvature nearly equal to that of the drum 80. The assembly is journaled by a shaft 113 which is inserted into a sleeve 114 coupled to the holder 110. To the sleeve 114 is secured a gear 115 which engages with a gear 116 driven by a suitable driving mechanism (not shown). The cleaning assembly is substantially surrounded by a cover 117 having an opening 118 and the cover is communicated to an air suction source by means of a duct 119. The shaft 113 is coupled with a rod member 120 by means of a pair of arms 121 and 122 and the rod member 120 is journaled by a bearing 123. As explained with reference to FIG. 7 the rod member 120 can be rotated by means of, for instance, a solenoid. By rotating the rod member 120 a surface of erasing member 112 can be either brought into contact with or separated from the surface of the drum 80. The erasing members 112 are commonly connected to the earth and thus when the erasing member is made in contact with the drum 80, undesired charge on the drum 80 can be discharged. Moreover in the present embodiment undesired toners on or near the drum surface can be removed by means of the suction air stream through the opening 118 and the duct 119. When the surface of the erasing member being in contact with the drum has been covered with a lot of toners, the gear 116 is rotated and a new clean surface of a next following erasing member can be brought into contact with the drum surface. During this operation the assembly may be separated from the drum 80 by rotating the rod member 120.

As explained above since the erasing device of this embodiment can remove undesired toners as well as undesired charge it may be arranged between any successive steps. On the contrary the erasing device shown in FIGS. 6 and 7 may be not provided between the development and transfer steps.

Figure 9A:
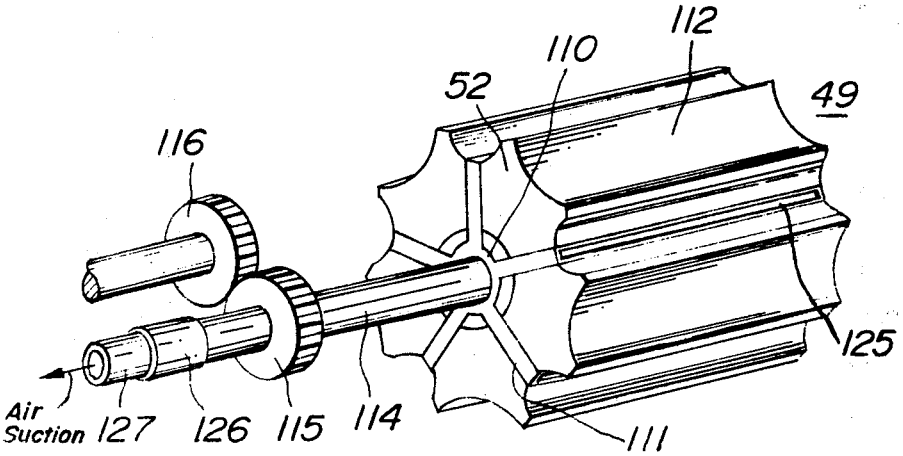
FIGS. 9A and 9B are perspective and sectional views, respectively illustrating another embodiment of the charge erasing device according to the invention.
Figure 9B:
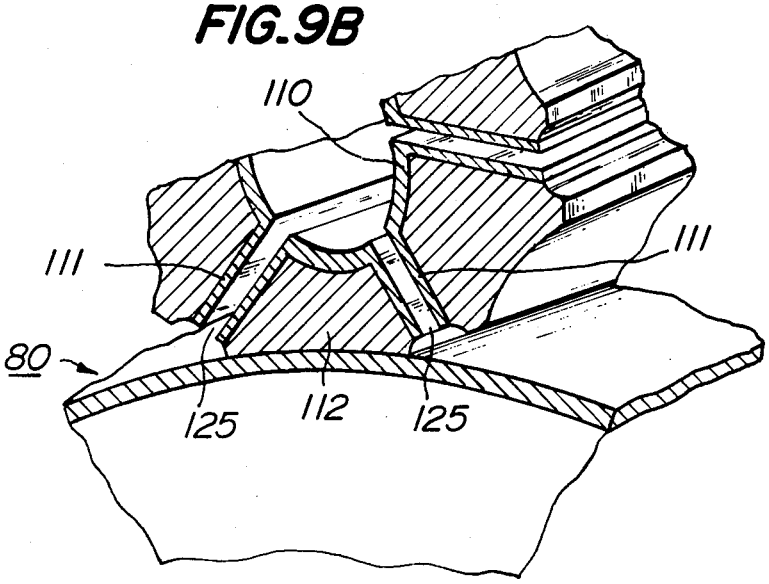

FIGS. 9A and 9B show a modified embodiment of the erasing device illustrated in FIG. 8. In this modified embodiment instead of the cover 117 (see FIG. 8) there is formed a vacant space in a holder 110 which is communicated with the outside through slots 125 formed in blades 111. The vacant space is further coupled with an air suction source through a sleeve 114, a universal joint 126 and a pipe 127. By applying a suction air to the pipe 127 undesired toner particles on the drum 80 are sucked through the slots 125. When a lot of toners are adhered to the surface of the erasing member 112, a new clean surface of a next erasing member 112 can be made into contact with the drum surface. Also in this embodiment the cleaning assembly may be separated from the drum surface in the same manner as the previous embodiments.

The erasing devices shown in FIGS. 8, 9A and 9B may be provided with a mechanism for sliding or moving the cleaning assembly in the axial direction of the drum 80 so as to cover a given peripheral portion of the drum.

Figure 10:
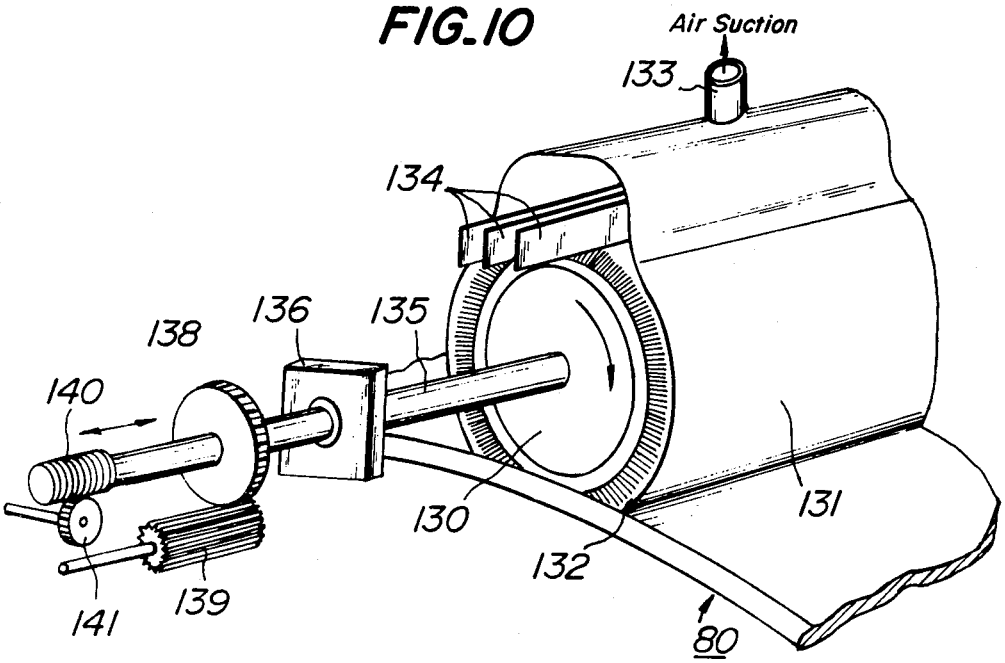
FIG. 10 is a perspective view showing still another embodiment of the charge erasing device according to the invention.

FIG. 10 is a perspective view illustrating still another embodiment of the erasing device according to the invention. In this embodiment use is made of a brush roller 130 composed of an electrically conductive roller made of soft rubber and fibers put in the rubber roller and made of electrically conductive and resilient material. The brush roller 130 is substantially surrounded by a cover 131 having an opening 132. The cover 131 is connected to an air suction source by means of a duct 133. In the cover there are further arranged three blades 134 for removing toners from the brush roller 130. The toners thus removed are conducted away through the duct 133. To the brush roller 130 is secured a shaft 135 which is journaled by a bearing 136. To the shaft 135 is secured a gear 138 which engages with a gear 139 driven by a suitable mechanism (not shown). To a free end of the shaft 135 is further fixed a gear 140 which engages with a gear 141 driven by a suitable mechanism in accordance with a paper size to be used. Thus when the gear 141 is driven the brush roller 130 can be moved in the axial direction, so that the brush roller 130 can cover a given peripheral portion of the drum 80. Then the gear 139 is rotated and undesired charge as well as undesired toners on the drum can be brushed away from the drum surface. Toners adhered to the brush roller 130 can be scraped by the blades 134 and the scraped toners are conducted away through the duct 133.

The present invention is not limited by the embodiments explained above and many modifications may be possible within the scope of the invention. For example as the mechanisms for sliding the cleaner assembly in the axial direction of the drum and for rotating the cleaner assembly any known mechanisms may be utilized. Further it is possible to use various devices for effecting the transfer, cleaning, latent image forming steps, etc.

What is claimed is:

1. An electrophotographic apparatus for printing a number of duplicated copies by repeating developing, transferring and fixing steps in succession for the same and single electrostatic charge latent image which corresponds to an image of a document to be duplicated comprising: an electrostatic charge retentive member including an electrically conductive substrate and a charge retentive layer applied on the substrate; means for forming the electrostatic charge latent image on the retentive layer means for developing the latent image with toner particles to form a visible toner image; means for transferring the toner image onto an image receiving member which is fed in contact with the charge retentive layer at least at a transfer region; means for applying a transfer bias voltage between said transferring means and the conductive substrate; means for fixing the transferred toner image on the image receiving member to form a final copy; first means for preventing undesired charge from being retained on that portion of the retentive layer which is not made in contact with the image receiving member in the transfer region, said first means comprising means for controlling said transferring bias applying means in such a manner that the application of the transfer bias voltage is allowed only when the image receiving member exists in the transfer region; and second means for removing an undesired charge retained on a peripheral portion of the retentive member free of contact with the image receiving means.

2. An electrophotographic apparatus according to claim 1, wherein said transfer means comprise at least one roller made of electrically conductive material and arranged in contact with the charge retentive layer, the image receiving member is fed between the roller and the charge retentive layer, and said transfer bias controlling means comprise a switch connected between the roller and a transfer bias voltage supply source and means for actuating said switch in synchronism with the traveling of the image receiving member.

3. An electrophotographic apparatus according to claim 1, wherein said transfer means comprise at least one transfer corona charger having an electrically conductive grid, the image receiving member is fed between the grid of the transfer corona charger and the charge retentive layer, and said transfer bias controlling means comprise a switch connected between said grid and a transfer bias voltage supply source and means of actuating said switch in synchronism with the traveling of the image receiving member.

4. An electrophotographic apparatus according to claim 1, wherein said charge retentive means comprise a metal cylindrical body and a charge retentive layer applied on the metal cylindrical body, said transferring means comprise first and second electrically conductive rollers and a transfer corona charger arranged between said rollers and having an electrically conductive grid, and said transfer bias controlling means comprise a first switch connected between the first roller and a bias voltage supply source, a second switch connected between the grid and bias voltage supply source, a third switch connected between the second roller and a bias voltage supply source, means for driving said first, second and third switches, and means for actuating said driving means in synchronism with the traveling of the image receiving member.

5. An electrophotographic apparatus according to claim 1, said charge retentive means comprise a photoconductive layer and said electrostatic charge removing means comprise light projecting means which project light onto at least a part of that portion of the photoconductive layer which is not covered with the image receiving member.

6. An elctrophotographic apparatus according to claim 2, wherein said light projecting means comprise at least one lamp which can illuminate a peripheral portion of the photoconductive layer having the maximum width and light control means for adjusting the illumination light in such a manner that only a peripheral portion of the photoconductive layer having a given width within said maximum width can be illuminated in accordance with a width of the image receiving member to be used.

7. An electrophotographic apparatus according to claim 1, wherein said undesired charge removing means comprise an electrostatic charge erasing device which is selectively made into contact with the charge retentive layer in accordance with a size of the image receiving member to be used so as to discharge the charge retentive layer.

8. An electrophotographic apparatus according to claim 4, wherein said electrostatic charge erasing device comprises a contact surface made of electrically conductive and flexible material.

9. An electrophotographic apparatus according to claim 4, wherein said electrostatic charge erasing device is movably supported in a direction of the width of the charge retentive layer in accordance with a size of the image receiving member to be used.

10. An electrophotographic apparatus according to claim 4, wherein said charge retentive means comprise a cylindrical body made of electrically conductive metal and a charge retentive layer applied on the cylindrical body and said electrostatic charge erasing device has a concave erasing surface which has a curvature substanttially equal to that of the cylindrical charge retentive means.

11. An electrophotographic apparatus according to claim 10, wherein said charge erasing device has a plurality of concave erasing surfaces which are assembled in a form of a polygonal prism having a longitudinal axis parallel to an axial direction of the cylindrical charge retentive means and said charge erasing device is arranged rotatably about its longitudinal axis.

12. An electrophotographic apparatus according to claim 11, wherein said charge erasing device is substantially surrounded by a cover having an opening through which the erasing surface is brought into contact with the charge retentive means and the cover is coupled to an air suction source.

13. An electrophotographic apparatus according to claim 11, wherein said charge erasing device has slots between successive erasing surfaces and these slots are communicated to an air suction source.

14. An electrophotographic apparatus according to claim 7, wherein said electrostatic charge erasing device comprises a brush roller made of electrically conductive resilient material, at least one blade for scraping toner out of the brush roller, a cover substantially surrounding the brush roller and having an opening through which the brush roller is brought into contact with the charge retentive means, means for rotating said brush roller and means for conducting a suction air stream through the opening and the cover.

* * * * *